US005431024A

United States Patent [19]

Hobelsberger

[11] Patent Number: 5,431,024

[45] Date of Patent: Jul. 11, 1995

[54] PROCESS FOR APPLYING ENGRAVINGS ON THE SURFACE OF AN ICE BODY, IN PARTICULAR A TRANSPARENT ICE BODY, AND ENGRAVED ICE BODY

[76] Inventor: Josef Hobelsberger, Fritz-Reuter-Str. 9, Tostedt, D-2117, Germany

[21] Appl. No.: 216,602

[22] Filed: Mar. 9, 1994

[30] Foreign Application Priority Data

Sep. 10, 1991 [DE] Germany ..... 41 30 055.6

[51] Int. Cl.[6] ..... F25C 1/00

[52] U.S. Cl. ..... 62/75; 62/1

[58] Field of Search ..... 62/1, 66, 75, 340, 356

[56] References Cited

U.S. PATENT DOCUMENTS

| | | | |
|---|---|---|---|
| 2,514,942 | 7/1950 | Eaton | 62/1 X |
| 2,703,964 | 3/1955 | Ashley | 62/1 |
| 3,640,081 | 2/1972 | Hadden | 62/1 |
| 4,550,575 | 11/1985 | DeGaynor | 62/1 X |
| 4,625,518 | 12/1986 | Freedman | 62/1 |
| 4,990,169 | 2/1991 | Broadbent | 62/75 X |
| 5,035,911 | 7/1991 | Somura | 62/1 X |

*Primary Examiner*—William E. Tapolcai

*Attorney, Agent, or Firm*—Omri M. Behr; Matthew J. McDonald

[57] ABSTRACT

A pair of ice bodies each have a planar surface which are warmed to melt the surface. Then at least one of the surfaces is provided with a cavity engendered by the application of a dimension controlled heat source, suitably by engraving with a heated relief formed die-like tool having a metal engraving element of a given design. The engraving element is warmed above the ice melting temperature and brought into contact with a planar surface of the surface of the ice body so that the element melts away portions of the ice body in the area of the element and the melt water is simultaneously removed by gravity, a vacuum or by a blast of cold air. When the desired engraving depth has been attained, the planar surfaces of the ice bodies to be mated are wetted by warming and are pressed together and if needed, cooled to freeze the interface producing an assembled ice body with an internal engraving and a transparent seam. Both bodies can be engraved in mirror image fashion with the engravings aligned and mated to form a single engraving in the composite body. The engraving brilliantly stands out from its surroundings in a drink medium because of the different light refractive indices.

21 Claims, 4 Drawing Sheets

PROCESS FOR APPLYING ENGRAVINGS ON THE SURFACE OF AN ICE BODY, IN PARTICULAR A TRANSPARENT ICE BODY, AND ENGRAVED ICE BODY

RELATED APPLICATIONS

This application is a continuation in part of International PCT Application number PCT/DE92/00766 filed 9 Sep. 1992 now abandoned.

FIELD OF THE INVENTION

The present invention relates to engraving an ice body, and in particular, a transparent ice body.

DISCUSSION OF THE PRIOR ART

Ice bodies, particularly ice figures, are used in superior gastronomic functions such as cold buffets, receptions, and banquets for ornamentation and decoration, often in conjunction with floral decorations, as well as effective illumination. Small ice bodies are classically utilized for the cooling of drinks.

For the optical improvement of such ice bodies, German Patent DE 3 90 93 318 discloses the formation of an open volume in the ice body, the placement therein of an included element such as fruit and the like, the filling of the open volume with water and then freezing the combination so that the ice body has an included body therein.

It is known from German Patent DE-A 3 133 616 to produce an ice figure from ice blocks utilizing a hammer and chisel. This reference further discloses that it is possible to work on a clear ice surface, either with a knife or a chisel or with a pre-warmed tool, having an included heating means, such as for example a soldering iron.

SUMMARY OF THE INVENTION

Heretofore, however, none of the known procedures disclose engraving the outer or inner surfaces of ice bodies, in particular, transparent ice bodies. The present invention is a recognition of a need for an engraving process in which an engraving has sharp contours on the inner or outer surfaces of an ice body and which make it possible to engrave such ice bodies in substantial numbers.

There is provided a process for creating a closed cavity in an ice body utilizing a dimension controlled heat source comprising the steps of providing a first ice body with a planar surface; causing the heat source to provide a melting temperature above the temperature of the ice body; applying the heat source to the said planar surface of the said first ice body to melt the ice thereof so that the portion of the surface thereof corresponding in area to the crossectional area of the cavity to be formed is melted; maintaining the application for a period until the cavity has a desired periphery and penetration depth in the surface of the ice body; removing the melt water; providing a second ice body having a planar surface thereon; warming the said planar surfaces sufficiently to form a wettened surface layer of water thereon and then sealing the said wettened surfaces to each other by mutual intimate contacting to form a third composite ice body with the cavity internal the third body.

In the process the planar surfaces are either wettened prior to the cavity formation step or are wettened subsequent to the cavity formation step.

The step of removing the melt water efficiently ensures the formation of a cavity with a clearly defined periphery. This procedure includes moving the heat source to the surface to be have the cavity formed therein in a direction opposite to gravity so that the melt water runs off in the gravitational direction. Alternatively, this may be achieved by moving the surface to have the cavity formed therein in the direction of gravity towards the heat source so that the melt water runs off in the gravitational direction.

If desired, the surfaces to be contacted and frozen to each other may be wettened by exposure to a heat source before or after the cavity forming step. The heat sink nature of the two ice bodies is generall sufficent to extract the latent heat of solidification and thus freeze the interface, nevertheless external cooling may be applied to achieve this end.

Where the process includes forming a cavity in each of said surfaces of the first and second bodies, the composite is formed by aligning the peripheries of the cavities in each said surfaces and then sealing the aligned surfaces by freezing the wettened surfaces therebetween. In a preferred mode the cavities in each said first and second bodies are mirror images of each other.

If desired, the depth of said cavities may have the same value.

Preferrably the first and second ice bodies are of substantially clear transparent ice so that the sealing forms a sealed interface region that is substantially transparent.

The melt water may be removed by suction or by a cold air blast.

The dimension controlled heat source may beany type known to the art, it may be a programmable laser beam or, in its simplest form, a stamp-like tool having an ice penetrating area comprising relief-formed engraving elements. It may be heated by internal sources such as heating coils, which may be thermostatically controlled, holding the temperature of the engraving element at a substantially constant value during engraving or it may be extrnally heated and reheated as needed.

The engraving elements may include picture elements including type-face characters.

In the process the ice bodies to be engraved have a temperature of approximately −10° C. to +2° C.

In one embodiment step of intimately contacting the engraved ice body and unengraved ice body comprises anti-parallel sliding together of the ice body planar surfaces, to apply at the same time a pressure in the direction normal to the planar surface of the engraved body. It is contemplated to include engraving the planar surfaces of each ice body with a mirror image engraving and then bringing the mirror image engravings together to form a composite single engraving in the contacted bodies.

This invention makes available for the first time a transparent ice body comprising a block of transparent ice having a closed cavity therein. Suitably, the body is substantially seamless and the cavity is in the form of a symbol or character. In alternate embodiments, the cavity need not be empty or air filled, it may further contain colored liquid or solid particles, suitably, snow particles.

Such ice bodies with inner engraving can be used for a plurality of decorating or cooling functions.

BRIEF DESCRIPTION OF THE DRAWINGS

Further advantages and characteristics of the present invention will appear from the description of the examples, as well as from the drawings, in which.

DESCRIPTION OF THE PREFERRED EMBODIMENTS

Figure 2:
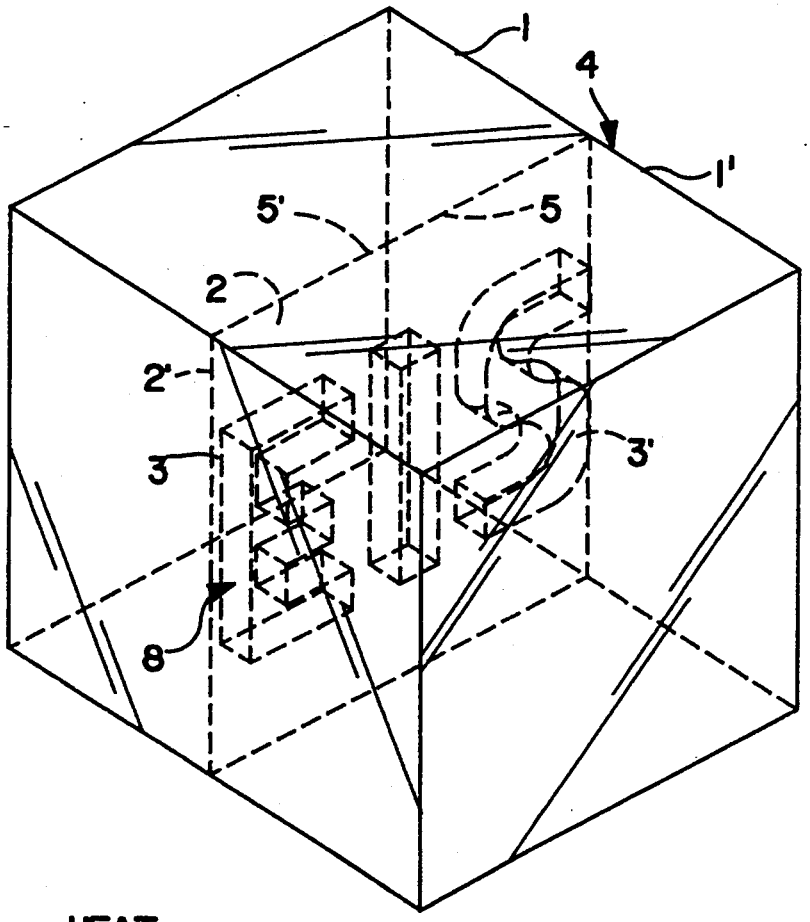
FIG. 2 is an isometric view of the embodiment of FIG. 1 of a completed ice body having an internal engraving formed by the separate engravings of the embodiment of FIG. 1.

In FIG. 2, transparent ice body 4 has an engraving 8 in the form of hollow spaced coplanar letters E I S interior of the body 4. The cavity forming each of the letters is filled with air in this embodiment, but in the alternative, according to a given implementation may include a liquid such as colored water which is frozen in place in the engraving. Solid material, such as food items or other articles or decorative material may also be placed in the engraving and frozen in place if desired.

Figure 1:
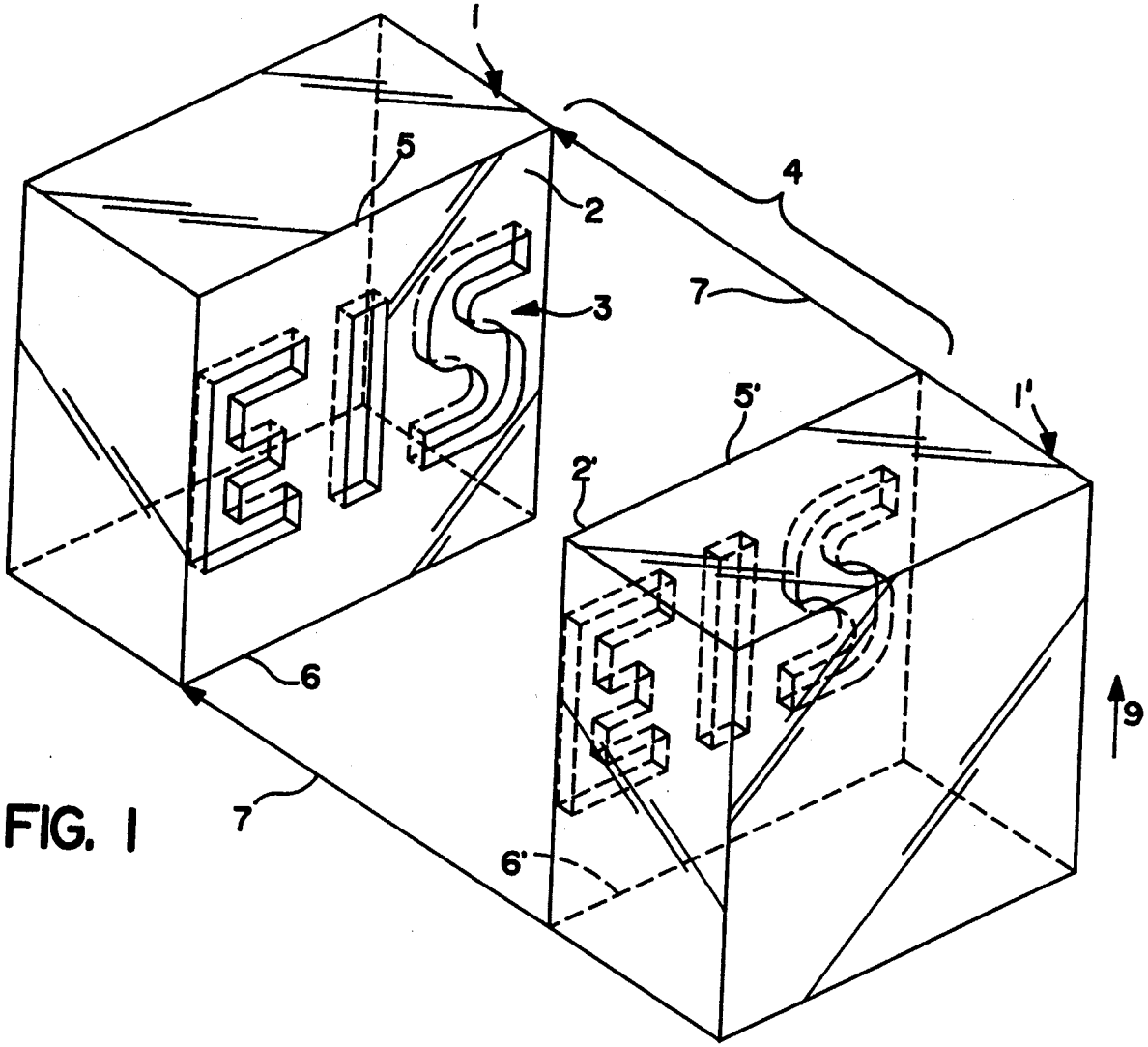
FIG. 1 is an isometric view of two transparent like ice bodies, wherein each has an engraved mating surface forming a common engraving produced by a process in accordance with one embodiment of the present invention.

In FIG. 1, one embodiment is illustrated for forming the ice body 4 of FIG. 2. Ice body 4 comprises two like mirror image segments 1 and 1'. Corresponding mirror image parts of ice body segments 1 and 1' have the same reference numbers, with segment 1' parts having an apostrophe. Ice body segment 1 has an external surface 2 with an engraving 3 formed in surface 2. Engraving 3 forms a portion of engraving 8 of FIG. 2. An identical mirror image engraving 3', in this example, is formed in mirror image relation to engraving 3 in surface 2' of segment 1'. When the segments are joined as shown in FIG. 2 in a manner to be explained below the engravings 3 and 3' merge as one engraving forming engraving 8. In the alternative, only one of the segments need have an engraving formed therein in other embodiments such that the flat unengraved surface of one segment encases the engraving of the other engraving to form an ice body similar to body 4 of FIG. 2. The dashed line 10 represents the interface of joined surfaces 2 and 2', which interface is not visible in body 4 and no seam is formed thereat in the joined segments. This will become clearer below when the process for joining segments 1 and 1' is explained.

Figure 3:
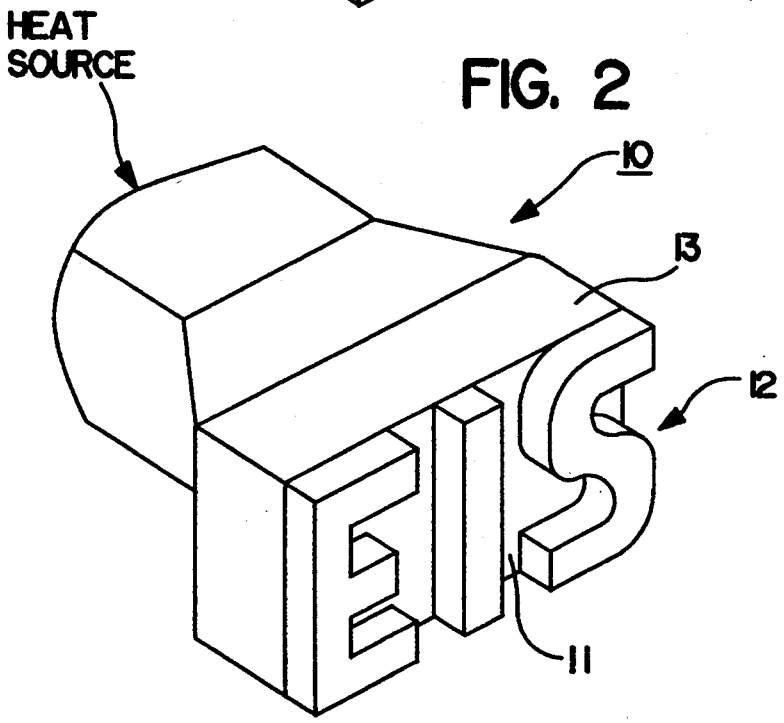
FIG. 3 is an isometric view of the engraving face of an engraving tool for use in one process according to the present invention.

In FIG. 1, the surfaces 2 and 2' of the segments 1 and 1' to be engraved and later joined together are initially warmed with a hot plate not shown or by other processes such as warm blown air and so on so that the surfaces 2 and 2' melt slightly and are wet. However, these wet surfaces remain planar and uniform for later joining to form an invisible joint as shown in FIG. 2. Thereafter, each wet surface 2 and 2' is engraved with a stamp-like tool 10, FIG. 3, whose pressing area has a metallic heated relief-formed engraving element 12 formed with the desired engraving data to be engraved, e.g., letters EIS, so as to simultaneously engrave the letters EIS. It will be understood that depending on the depth to be engraved and the temperature differential between the tool and the ice, the engraving may occur in one or several, engraving pressing step. The engraving is carried out relatively quickly while maintaining the surfaces 2 and 2' wet. It is preferable that the entire engraving be formed and shaped by a single formed tool, such as tool 10, in the interest of speed of engraving.

Figure 4:
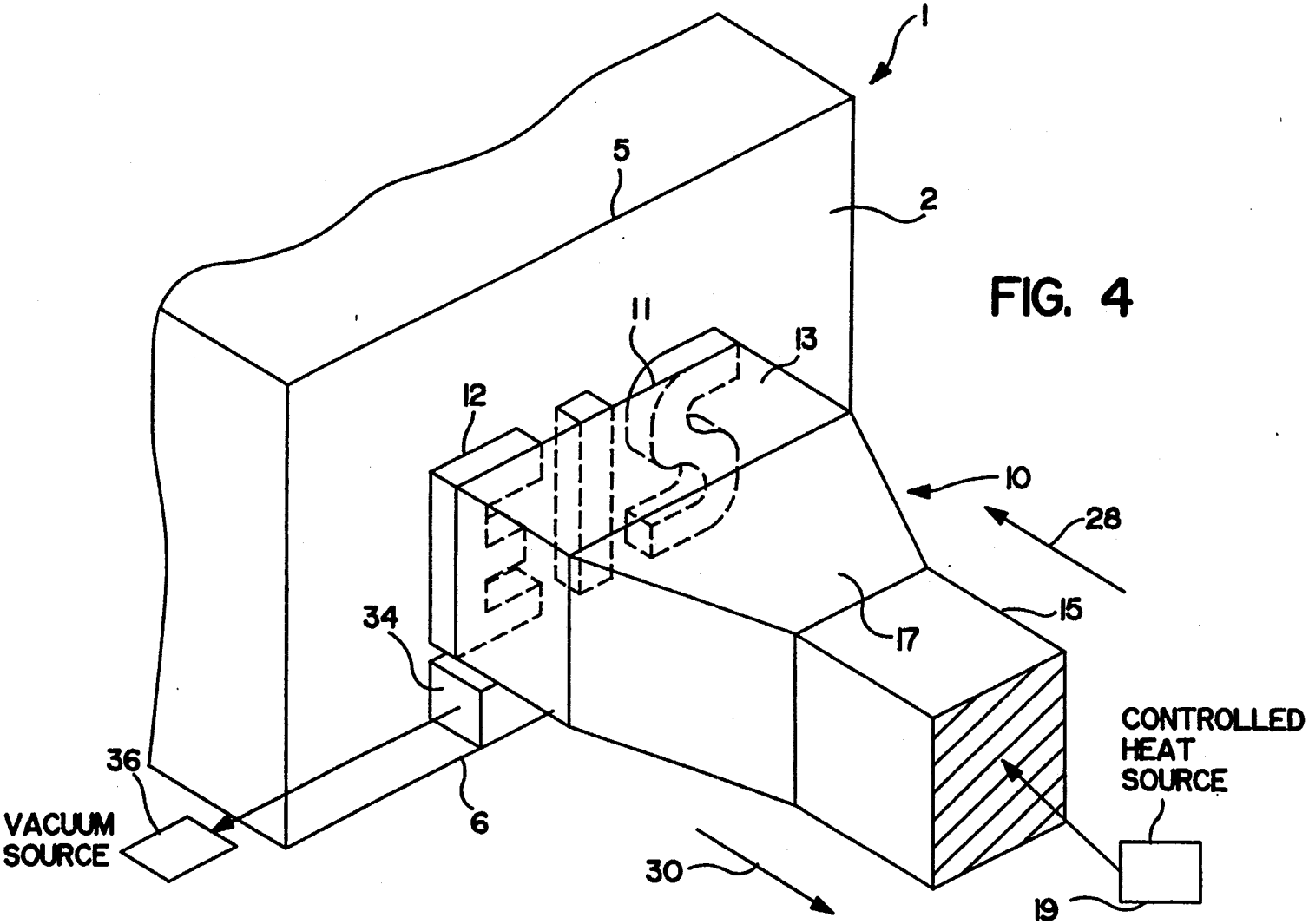
FIG. 4 is an isometric view illustrating the tool of FIG. 3 being used to engrave one of the ice bodies of FIG. 1.

In FIG. 4, tool 10 comprises a relatively large metal heat transfer mass 13 with a planar front face 11. The mass 13 is a right rectangular polygon but may be any shape in accordance with the shape of the engraving element such as element 12. A heat transfer member 15 is thermally conductively connected to mass 13 by a transition member 17. The mass 13 is preferably sufficiently large so as to have a latent heat capacity for completing the engraving 3 or 3' of FIG. 1. The engraving process melts the ice forming water which is caused to immediately run off or otherwise removed from the body 1. The mass 13, FIG. 4, may have sufficient heat to melt the entire mass of ice forming the hollow engraving cavity. However, preferably, heat is continuously supplied to the mass 13 via members 15 and 17 by a temperature controlled heat source 19 to maintain the temperature of the mass 13. Of course, as the engraving element such as element 12 is given a particular overall set of dimensions, the size of the heating mass also is sized accordingly.

The engraving element 12 in this case, for example, the letters EIS, are warmed to a temperature above the melting point of the ice bodies 1 and 1'. The heat passing from the engraving element 12 into the ice of body 1 and 1' is continuously heated by source 19, FIG. 4, so as to maintain a constant temperature when element 12 contacts the ice. The amount of heat needed to do this is established for each implementation. This is preferably temperature controlled by an electronic control, but could be electrically controlled or manually heated by an external heat source such as a hot plate. The important criteria is that the engraving be formed accurately and with rapid removal of the melt water.

The temperature of the engraving element 12 should preferably be constant to ensure a uniform engraving with sharp contours. The temperature is above the melt point of ice and is within the range of +2° C. to +95° C. but preferably about 20° C.–50° C. The level of temperature allows for rapid engraving while not melting the ice so quickly that there is an unclarity at the edges. These temperatures can be easily determined empirically. At a minimum, tool element 12 should be at least 1° C. higher than that of the ice being melted.

A particular problem is caused by the removal of melting water so that if this melting water if allowed to remain too long, has a negative influence on the sharpness of the gravure contours. Thus, it is preferred to remove this melt water in a positive manner.

Furthermore, it is particularly advantageous for the removal of melting water during the engraving, to operate the engraving tool in a direction opposite the force of gravity, against the surfaces 2 and 2' to be engraved, or to displace the surfaces 2 and 2' in the direction of the force of gravity against the engraving tool during engraving so that the melting water constantly runs off in the direction of gravity. Thus, it is important that the opening of the engraving faces downward relative to the force of gravity so that the melt water rapidly runs out of the engraved cavity. This produces a clean sharp engraved cavity.

For example, in FIG. 4, the element 12 is applied to ice body 1 in direction 28 which is in the upward direction as defined herein. Preferably the body could be oriented so that the surface faces downwardly relative to the force of gravity to cause the melted ice water to leave the body 1 at the engraving 3. The body 1 could also be moved simultaneously or in the alternative in the direction 30 downward against the element 12 in the direction of the force of gravity. To assist in removing melt water, a vacuum device 34 with a resilient nozzle so as to not damage the ice body is coupled to vacuum source 36. Device 34 vacuums melt water adjacent to the engraving during its formation as the water is formed by tool 10. The melt water may also be removed with a blast of cold air.

The engraving element 12, FIG. 4, is held against the ice body 1 for a period sufficiently long until the desired penetration depth of the surface 2 or 2' of the ice body is achieved. Preferably the element 12 has a depth in direction 28 greater than the desired engraving depth. To this extent the depth of penetration is held constant by a guide element (not shown) secured to tool 10. Such a guide element may comprise one or more spikes secured to the tool in thermal isolation to limit the depth of penetration of the element 12 into the ice. Spikes are used to minimize damage to the ice surfaces. Such guide elements may also include guide spikes connected temporarily to the sides of the ice bodies to form a fixture for holding the tool 10 and for locating the engraving elements on the surfaces 2 and 2'.

If desired, the engraving can be carried out several times with the same or different elements such as element 12 using the same guide fixture until the desired penetration depth is achieved. Such a guide fixture comprises a frame (not shown) for thermal isolation holding the tool 10 and permitting the tool 10 to displace in directions 28 and 30, FIG. 4, during engraving. Both ice body segments 1 and 1' are so engraved preferably simultaneously using further fixtures not shown for holding the ice bodies during engraving. The engraving may be in the alternative be completed by apparatus not shown which holds the ice bodies and tool 10 and also displaces the tool 10 to perform the engraving action.

The still-wet surfaces 2 and 2' of the ice body segments 1 and 1' are brought together into intimate contact, depending on circumstances some application of pressure may be needed to facilitate seamless freezing. However, in the case of the present example, it is preferred to place the ice body segments 1 and 1' under pressure in the direction of the arrows 7 in FIG. 1, until the bodies are adjacent and then position the segments such that the edge 5 of ice body 1 contacts the edge 5' of ice body 1' and edge 6 contacts edge 6. Alternatively, block 1' is placed "under" block 1 so that edge 5' contacts edge 6. Then the ice body 1' is moved "upwardly" and anti-parallel, i.e., slid in direction of the directional arrow 9, of FIG. 1, so that edges 5 and 5' and 6 and 6' ultmately come to lie together and the wet surfaces 2 and 2' engage in a quasi-sliding relation. This has the advantage that through the sliding movement of the wet surfaces 2 and 2' as they come into contact with each other, the formation of air inclusions between the upper surfaces 2 and 2' is minimized. As a result, gaps are avoided at the interface of surfaces 2 and 2'. Such gaps could cause an opening through which drink fluid in which the ice body 4 is immersed can intrude or the optical bulk and brilliance of the engraving 3 is disturbed. Needless to say the foregoing juxtaposition and sliding action could take place between any of the appropriate pairs of edges. Thus the terms "under" and "upwardly" apply only in the specific case discussed.

After the surfaces 2 and 2' are engaged, the entire structure is subject to freezing temperature to freeze the wet surfaces 2 and 2' to form an integral structure with no seams. Based upon the example of the double engraving of the surfaces 2 and 2', a three-dimensional hollow engravure 8, FIG. 1, is created within the ice body 4. The water at the surfaces 2 and 2' by freezing fills any minor roughness in these surfaces which generally has been removed by melting these surfaces in the initial step and forms an optically transparent interface therebetween.

It is particularly preferred to hold the temperature of the ice bodies 1 and 1' to be engraved between −9° C. to 0° C. Where temperatures lower than −10° C. are present in the ice bodies 1 and 1', there is a procedural disadvantage, since during engraving with a hot engraving tool, cuts or cracks may occur.

Thus by means of the procedures of the present invention, it is possible to provide an ice body 4 based on its formation out of clear transparent ice, having internally thereof, a predetermined lettering, in this case EIS. This lettering has, based upon its filling with air, a different refractive index than that of the surrounding ice and thus shows an excellent contrast to the ice itself, as well as to the drink fluid (not shown) surrounding the ice body 4. Such ice bodies can be utilized for the decorative cooling of food and drink. While lettering has been illustrated other types of engravings can also be utilized where desired according to a given implementation. Inserts may be placed in the engraving such as colored liquid, flowers or other decorative material.

When a hermetic sealing of the engraved volume within the ice body is desired, it is advantageous that the ice body after it has been pushed together under pressure, is briefly washed with water and only then cooled, so that any openings which had by chance occurred in the interface between the ice bodies are filled with water and after further cooling yield a unitary ice body with an internal engraving, wherein the interface lines are substantially optically negligible.

The surfaces 2 and 2' while preferably wetted with a hot plate may also be wetted with hot air, a heat lamp or other devices. It is important that the heat does not penetrate deeply into the ice which would be detrimental to the later formed engraving. Thus, for example, hot air may be blown parallel to the surfaces 2 and 2' or at a small angle. The placement of a hot plate in the proximity of these surfaces is preferred to provide a controlled depth of melt at these surfaces. If the ice body is below the freezing temperature there is sufficient latent cooling so as to freeze the wet surfaces 2 and 2' provided the engraving is rapid so that the surfaces remain wet after engraving. A preferred environment temperature for this process is +5° to −5° C.

The body 4 segments 1 and 1' may be held during the process by vacuum pads or small unobtrusive spikes. It is important not to undesirably damage or mark the body external surface during the engraving.

To fill the engraving with a fluid, the fluid can be inserted with a jet and the ice block then sealed by freezing. The engraved cavity may be filled with snow to give interesting optical effects. However, all melt water needs to be removed to remove unattractive refractive effects. Synthetically produced snow would be used in a food environment.

When the ice body having an inner engraving is fill with a colored drinking fluid, it may thereafter be placed in a substantially clear fluid, for example mineral water, which is to be cooled thereby. The ice body with the fluid in the engraving being immersed in the clear fluid while the drink fluid is isolated from the clear fluid.

The size of ice bodies can range from a few centimeters to full body size or more. It is preferred, however, that the ice bodies of the present invention are used in smaller form for the cooling of drinks.

For example, small ice bodies can be formed from clear ice, wherein ice plates are formed by the streaming of water over a cooling plate in accordance with clear ice technology and thereafter the ice plate is cut into individual ice dices by a heated wire grid. The surfaces of the ice cubes can then be engraved utilizing the procedures described hereinabove. The thickness of the ice plates created, as well as the grid mesh size of the wire grid permit the dimensions of the ice body to be varied substantially.

As a result of using two ice bodies, an engraving is formed in an ice block and sealed to formed a hollow cavity which may be filled with any desired material or gas. While in the preferred form, two engravings are matched and joined in two mating ice bodies, the engraving may be formed in one ice body and sealed with a planar surface of a second ice body if desired.

Figure 5:
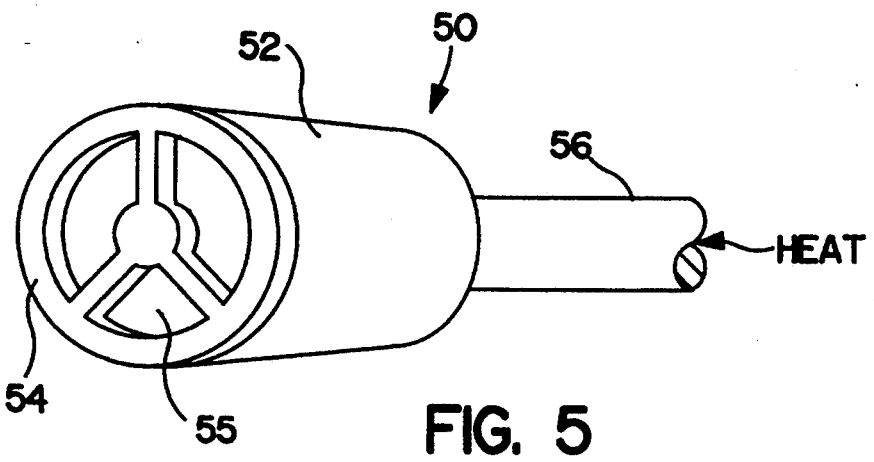
FIG. 5 is an isometric view of an engraving tool for forming an engraved ice body with a decorative pattern.

In FIG. 5, a tool 50 of a different design is shown. Tool 50 has a circular cylindrical heating mass shank 52 with an ornate design element 54 on the front planar face 55 of the shank 52. A heat transfer member 56 is connected to a heat source for heating the shank 52 and element 54.

Figure 6:
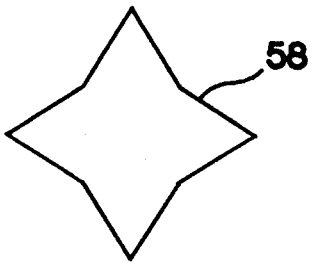
FIGS. 6–9 are front elevation views of the engraving faces of different respective engraving tools for engraving one or more ice bodies in accordance with the present invention.
Figure 7:
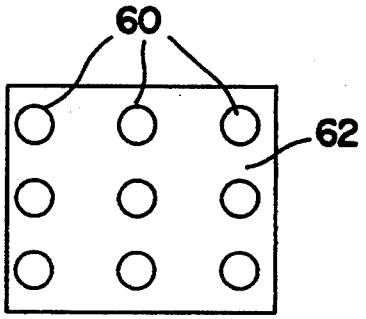
Figure 8:
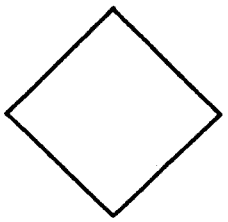
Figure 9:
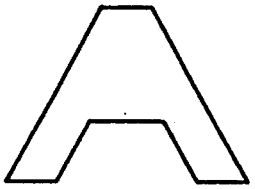

In FIG. 6 a star shaped engraving design element 58 is shown whereas in FIG. 7 an array of cylindrical engraving rods 60 are shown for engraving a decorative array of cylindrical apertures in the ice. The rods 60 upstand from a heat transfer mass 62 connected to a heat source. FIG. 8 illustrates a star shaped engraving element and FIG. 9 illustrates the letter A. In the latter case individual letters may be engraved coupled with other design elements to form a variety of design configurations.

In order to ensure contour sharpness, it is, however, important that the melted water be promptly and properly removed, since otherwise the edges of the engraving deteriorate due to melting caused by this water.

The still wet planar surfaces of the ice body are forced together under pressure and cooled below the melting point of the ice body so that there is obtained a composite ice body having an internal engraving in the form of an open volume. It is preferable that the ice body segments having wet surfaces are forced together under pressure since this avoids the occurrence of air bubbles being formed in the planar areas outside the engraved zone. Such air bubbles would cause disturbance zones in the internal composition of the ice body upper surfaces which can lead to the formation of cloudy ice and furthermore when such ice bodies are utilized for the cooling of drinks, the fluid of such drinks can intrude between the two ice bodes. Thus, under certain circumstances, channels may be formed into the engraved volume, whereby the engraved volume is filled with fluid and its refractivity will thus become similar to that of the drink fluid. Hence, the brilliant impression of the engraving would disappear.

The capability for mass production arises substantially in that the engraving, that is, the contacting of the engraving element with a surface of the ice body, may be automated in a production line, e.g., time-controlled, wherein the engraving content, e.g., the script characters, can be exchanged in a manner such as is found in a composing machine such as is known in printing technology and, if desired, may also be automatically selected.

Thus, it has been shown that by the engraving of a substantially planar surface of an ice body segment wherein this surface later lies within a composite ice body, it is possible, for example, to provide a composite ice body from two separate halves.

These ice bodies contain an engraving in their internal segments which, particularly in clear ice, have an optically integral unitary bulk appearance due to the different light refraction caused by the air filled engraved hollow volume.

What is claimed is:

1. A process for creating a closed cavity in an ice body utilizing a dimension controlled heat source comprising the steps of:

a) providing a first ice body with a planar surface;

b) causing the heat source to provide a melting temperature above the temperature of the ice body;

c) applying the heat source to the said planar surface of the said first ice body to melt the ice thereof so that the portion of the surface thereof corresponding in area to the crossectional area of the cavity to be formed is melted;

d) maintaining the application for a period until the cavity has a desired periphery and penetration depth in the surface of the ice body;

e) removing the melt water;

f) providing a second ice body having a planar surface thereon;

g) warming the said planar surfaces sufficiently to form a wettened surface layer of water thereon and then h) sealing the said wettened surfaces to each other by mutual intimate contacting to form a third composite ice body with the cavity internal the third body.

2. The process of claim 1 wherein the planar surfaces are wettened prior to the cavity formation step.

3. The process of claim 1 wherein the planar surfaces are wettened subsequent to the cavity formation step.

4. Process in accordance with claim 1 wherein the removing the melt water includes moving the heat source to the surface to have the cavity formed therein in a direction opposite to gravity so that the melt water runs off in the gravitational direction.

5. Process in accordance with claim 1 wherein the removing the melt water includes moving the surface to have the cavity formed therein in the direction of gravity towards the heat source so that the melt water runs off in the gravitational direction.

6. The process of claim 1 including cooling the third, composite, ice body after contecting the two wettened surfaces to freeze the water at the contacted surfaces.

7. The process of claim 1 including forming a cavity in each of said surfaces of the first and second bodies, aligning the peripheries of the cavities in each said surfaces and then sealing the aligned surfaces by said freezing the wettened surfaces therebetween.

8. The process of claim 7 wherein the cavities in each said first and second bodies are mirror images of each other.

9. The process of claim 7 including controlling the depth of said cavities to the same value.

10. The process of claim 1 including forming the first and second ice bodies of substantially clear transparent ice and said sealing forms a sealed interface region that is substantially transparent.

11. The process of claim 5 wherein the melt water is removed by suction.

12. The process of claim 5 wherein the melt water is removed by a cold air blast.

13. A process for creating a closed cavity of predetermined periphery, crossectional area and depth in an ice body utilizing a dimension controlled heat source comprising the steps of:

a) providing a first ice body with a planar surface;

b) providing, as the heat source, a stamp-like tool having an ice penetrating area comprising relief-formed engraving elements and causing the heat source to provide a melting temperature above the temperature of the ice body;

c) applying the heat source to the said planar surface of the said first ice body to melt the ice thereof so that the portion of the surface thereof corresponding in area to the crossectional area of the cavity to be formed is melted;

d) maintaining the application for a period until the cavity has a desired periphery and penetration depth in the surface of the ice body;

e) removing the melt water;

f) providing a second ice body having a planar surface thereon;

g) warming the said planar surfaces sufficiently to form a wettened surface layer of water thereon and then h) sealing the said wettened surfaces to each other by mutual intimate contacting to form a third composite ice body with the cavity internal the third body.

14. Process in accordance with claim 13 wherein the engraving elements include picture elements including type-face characters.

15. Process in accordance with claim 14 wherein the removing the melt water includes the step of moving the engraving tool to the surface to be engraved in a direction opposite to gravity and pressing the surface to be engraved in the direction of gravity upon the tool so that the melt water runs off in the gravitational direction.

16. Process in accordance with claim 13 wherein the remaining melt water remaining in the engraved space by adhesion is removed by a method selected from the group consisting of a blast of cold air against the melt water and suction.

17. Process in accordance with claim 13 wherein the ice bodies to be engraved have a temperature of approximately $-10°$ C. to $+2°$ C.

18. Process in accordance with claim 13 characterized wherein the ice body after engraving has the engraved surface thereof reengraved.

19. Process in accordance with claim 13 including holding the temperature of the engraving element at a substantially constant value during engraving.

20. A process in accordance with claim 13 wherein the step of intimately contacting the engraved ice body and unengraved ice body comprises anti-parallel sliding together of the ice body planar surfaces, to apply at the same time a pressure in the direction normal to the planar surface of the engraved body.

21. A process in accordance with claim 13 including engraving the planar surfaces of each ice body with a mirror image engraving and then bringing the mirror image engravings together to form a composite single engraving in the contacted bodies.

* * * * *